United States Patent [19]

Celli

[11] 3,973,548

[45] Aug. 10, 1976

[54] ENGINE WITH DIE CAST STATIC PARTS

[76] Inventor: Aldo Celli, 1730 First Federal Bldg., Detroit, Mich. 48226

[22] Filed: May 29, 1975

[21] Appl. No.: 581,784

[52] U.S. Cl. ..... 123/195 R; 123/90.1; 123/195 A; 123/195 C

[51] Int. Cl.[2] ..... F02F 7/00

[58] Field of Search ..... 123/90.1, 90.27, 195 R, 123/195 A, 195 C, 195 H

[56] References Cited

UNITED STATES PATENTS

| | | | |
|---|---|---|---|
| 1,377,811 | 5/1921 | Delano | 123/195 C |
| 2,865,341 | 12/1958 | Dolza | 123/195 R |
| 2,996,050 | 8/1961 | Caris | 123/195 R |
| 3,521,613 | 7/1970 | Celli | 123/195 R |
| 3,540,425 | 11/1970 | Scheiterlein | 123/195 R |
| 3,678,914 | 7/1972 | Vulliamy | 123/195 C |

*Primary Examiner*—Charles J. Myhre
*Assistant Examiner*—Daniel J. O'Connor
*Attorney, Agent, or Firm*—Barnes, Kisselle, Raisch & Choate

[57] ABSTRACT

An internal combustion engine, the static parts of which are formed as die castings. The engine includes a plurality of cylinders each closed at its upper end by an individual cylinder head casting. Each cylinder head casting has at least two tubular extensions thereon forming air intake and exhaust passageways and at least two valve stem guides. All of the cylinder head castings have flat horizontally extending upper faces all lying in a single plane and on which a valve train casing casting is seated. A single camshaft is journalled in the valve train casing and arranged to operate the intake and exhaust valves of all of the cylinders. The upper end of the valve trains casing is closed by a cover having a breather opening communicating with the interior of the valve train casing and also having air intake openings communicating with the air intake passageway of each cylinder. A shroud is mounted over the cover to define an air chamber which communicates with atmosphere through an air filter.

14 Claims, 9 Drawing Figures

ENGINE WITH DIE CAST STATIC PARTS

This invention relates to an internal combustion engine and, more particularly, to an internal combustion engine the static parts of which are designed and arranged so that they can be formed as die castings.

In my prior U.S. Pat. No. 3,521,613, dated July 28, 1970, there is disclosed an engine the design of which enables the static parts to be die cast. The use of die castings for the static parts of an internal combustion engine is highly desirable from the standpoint of both cost and weight of the engine. The present invention is directed to improvements in an engine of the general type shown in my said prior patent.

The primary object of the present invention is to provide an economical design for the cylinder head and valve casing castings for an engine of the type described.

More specifically, the object of this invention resides in the provision of castings for both the cylinder heads and a valve train casing which are designed so that they can readily die cast and which, at the same time, are conducive to economical manufacture and assembly.

A further object of the present invention resides in the provision of cylinder head castings and a valve train casing casting which permit the mounting of an air filter directly over and on the valve train casing casting in a manner as to permit air flow directly from the air filter to each of the intake valves through the valve train casing casting. This feature of the present invention eliminates the necessity for separate intake manifold sections, improves engine breathing and promotes direct recirculation of blow-by gases from the crankcase.

Other objects and features of the present invention will become apparent from the following description and the accompanying drawings, in which.

Figure 1:
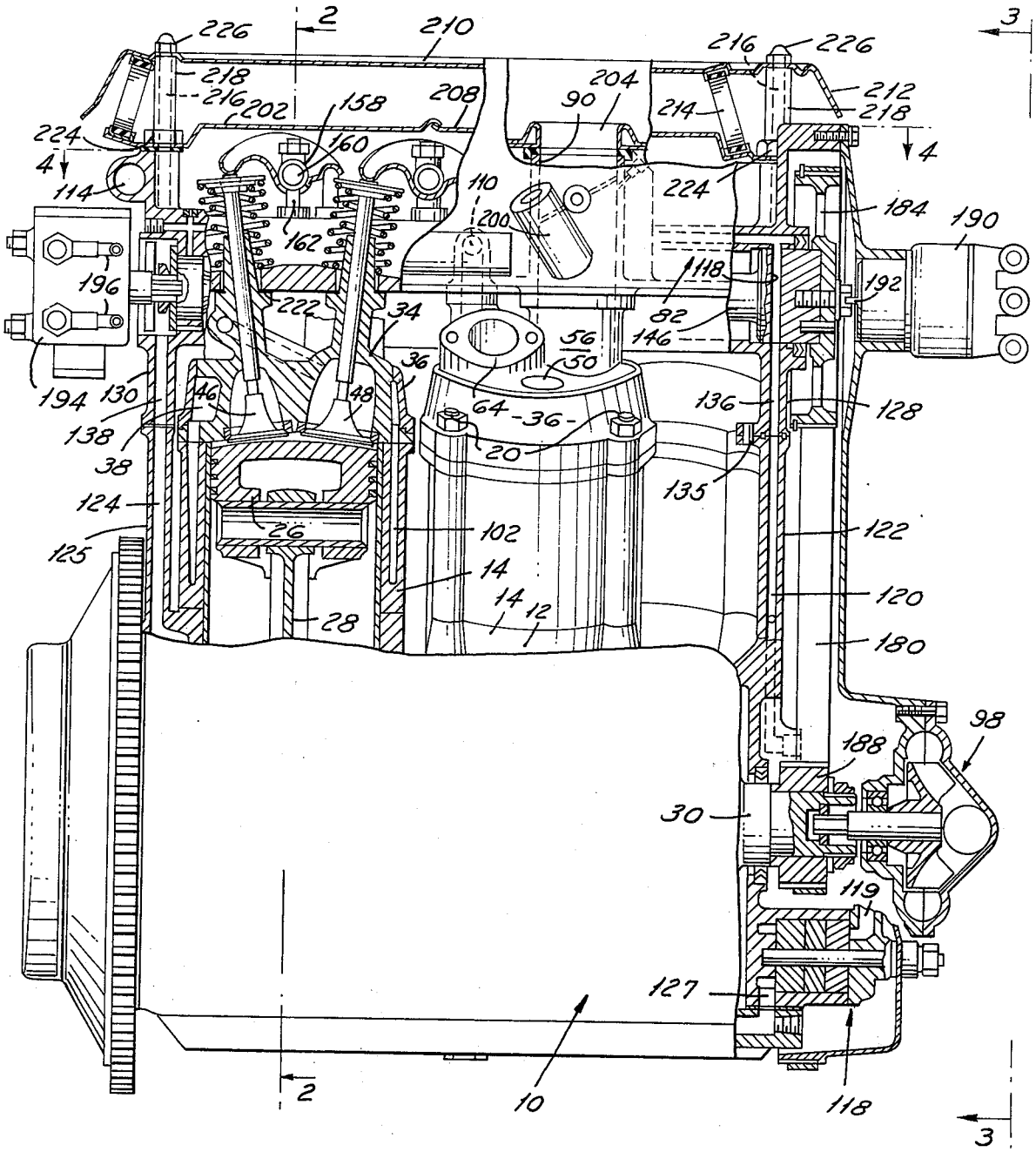
FIG. 1 is a side elevational view, partly in section, of an engine embodying the present invention.

The engine shown in the drawings and described herein illustrates the invention as applied to an internal combustion engine wherein each cylinder has a single intake and a single exhaust valve. As the description proceeds it will be appreciated that, except for the number of valves per cylinder, an engine embodying the present invention and provided with two intake and two exhaust valves per cylinder would have generally the same design and construction as the engine illustrated and described herein. Furthermore, to the extent that the components of the engine shown herein are substantially the same as shown in my aforesaid patent, they will be described only briefly — reference being had to said patent for the details thereof.

Figure 2:
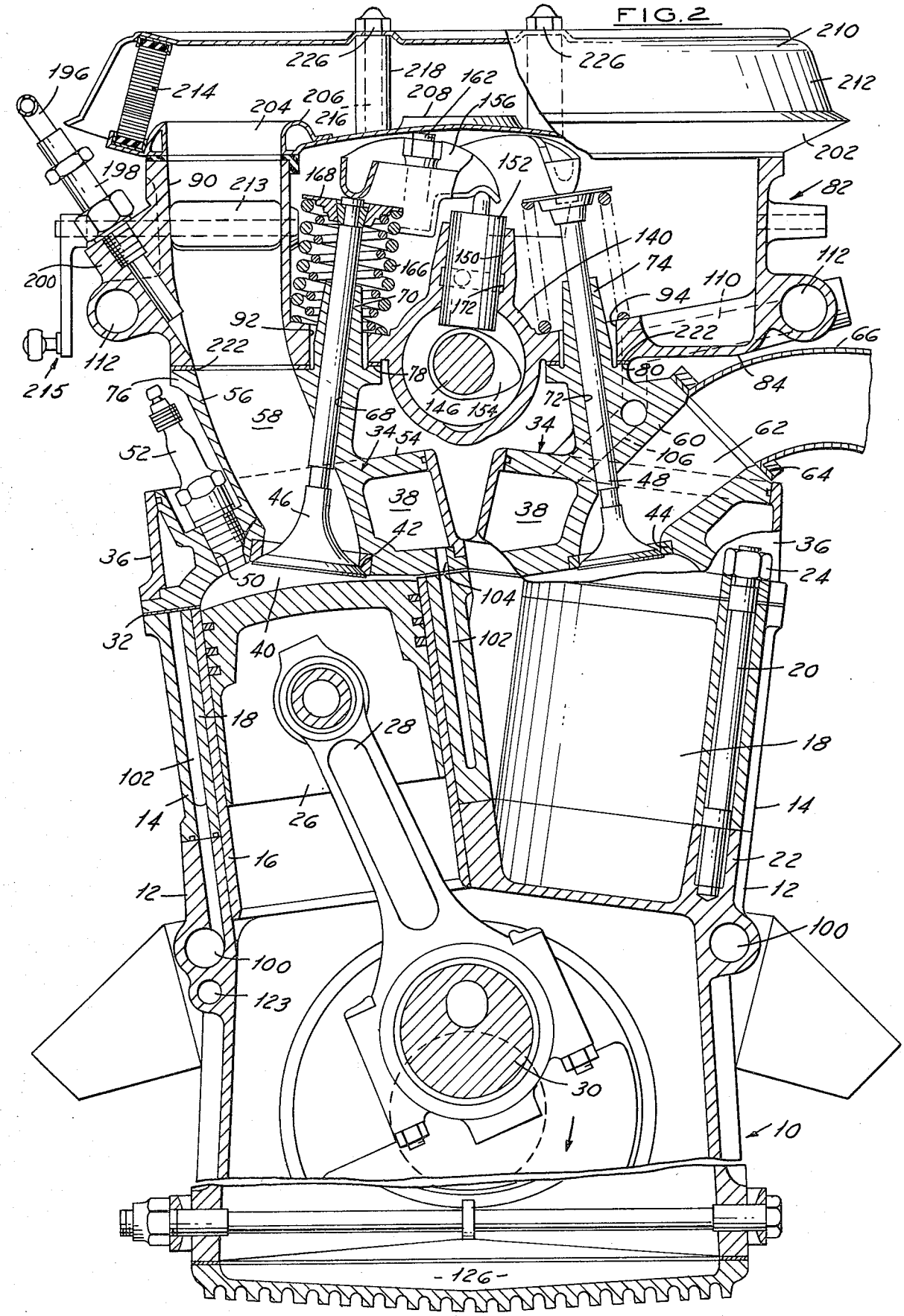
FIG. 2 is a sectional view along the line 2—2 in FIG. 1.
Figure 4:
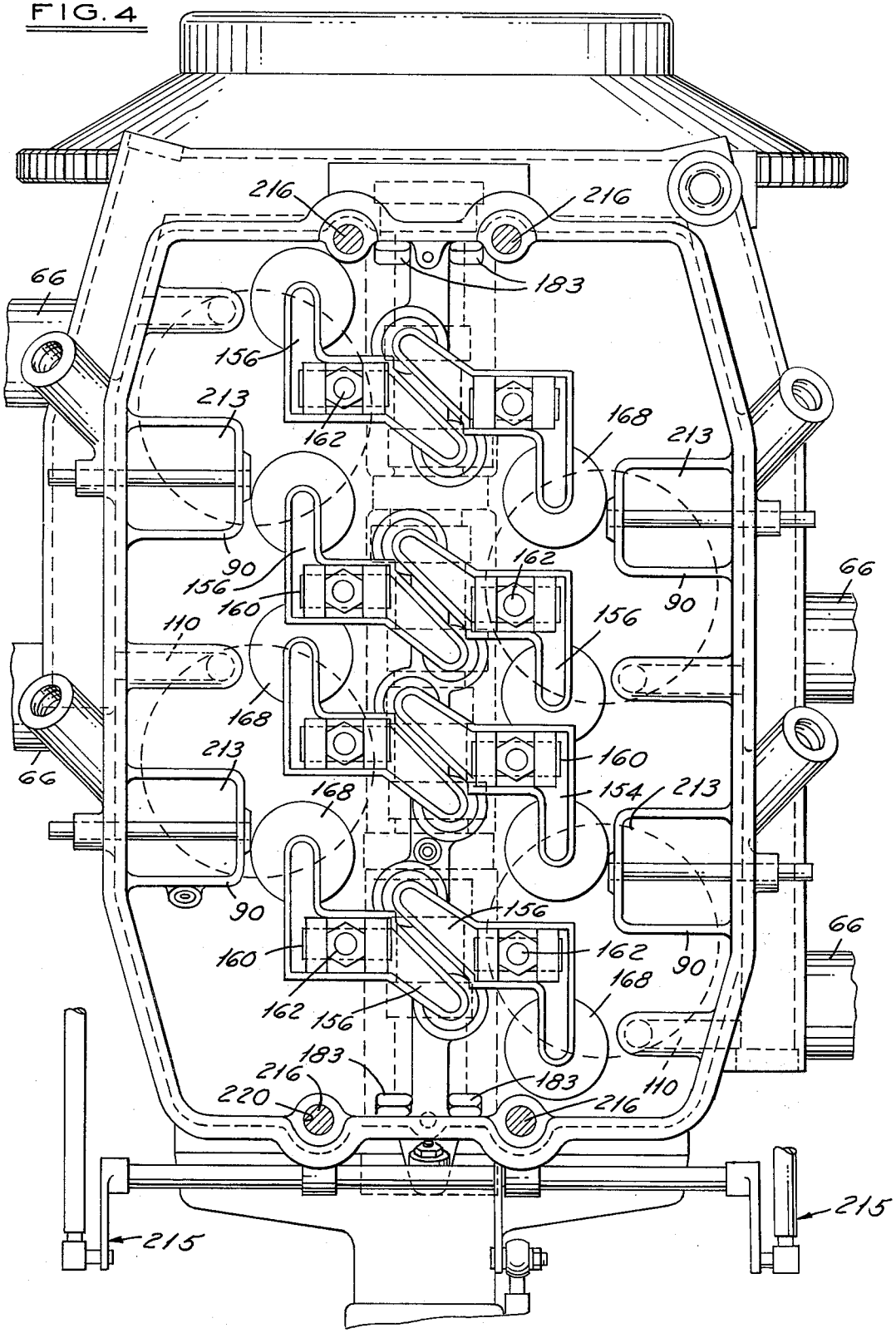
FIG. 4 is a sectional view along the line 4—4 in FIG. 1 with the air filter and valve casing cover removed.

Referring first to FIGS. 1 and 2, the engine includes a crankcase in the form of a die casting having two rows of cylinder extensions 12 integrally cast with the top wall thereof. The two rows of extensions 12 are inclined at a narrow V angle and are staggered as generally shown by the broken lines in FIG. 4. On the upper face of each cylinder extension 12 there is secured a die cast cylinder 14. Cylinders 14 have linings 16 cast-bonded to the cylindrical wall 18 thereof. Each cylinder casting 14 is piloted on its respective cylinder extension 12 by the extended liner 16 and is securely mounted on the crankcase 10 by studs 20 threaded into lugs 22 over the ends of which are threaded clamping nuts 24. Within the bore formed by each liner 16 there is arranged a piston 26 which is connected by a connecting rod 28 to a crankshaft 30 which is journalled in crankcase 10.

The upper end of each cylinder casting 14 is formed with a flat face and provided with a sealing gasket 32. On the upper end of each cylinder casting 14 there is arranged a cylinder head casting 34 which is surrounded by a cap casting 36 which cooperates with casting 34 to form an annular liquid coolant chamber 38. It will be observed that studs 20 extend upwardly through the flanged lower ends of casting 34, 36 so that nuts 24 clamp castings 34,36 and 14 in stacked relation on the upper ends of cylinder extensions 12 on the crankcase. Cylinder head castings 34 are shaped to provide a generally V-shaped combustion chamber 40 for each cylinder. At one of the sloping sides of each combustion chamber there is provided an intake port 42 and on the opposite sloping side thereof the combustion chamber is formed with an exhaust port 44. Intake ports 42 are controlled by intake valves 46 and exhaust ports 44 are controlled by exhaust valves 48. Adjacent each inlet port 42 cylinder head castings 36 are apertured to form a socket 50 for a spark plug 52.

Each cylinder head casting 34 is formed with a generally flat top wall 54 and with a tubular upward extension 56 forming an intake passageway 58 leading to intake port 42. Likewise, each cap casting 36 is formed with a laterally outwardly inclined extension 60 defining an exhaust passageway 62 leading from exhaust port 44. The end of each extension 60 is fashioned with a flat flange 64 to which an exhaust pipe 66 is connected. The tubular extension 56 on each cylinder head casting 34 is formed with an upwardly extending lug which is drilled as at 68 to form a valve stem guide 70 for the intake valve 46. Likewise, the inclined extension 60 on each cylinder head casting 34 is cast with a lug drilled as at 72 to form a valve stem guide 74 for the exhaust valve 48.

The upper end of each intake passageway extension 56 is formed as a flat annular flange 76 which merges with a flat annular flange 78 around each valve stem guide 70. Likewise, each valve stem guide 74 is formed with a flat flange 80. In the assembled relation of the cylinder head castings 34 the flanges 76, 78, 80 extend horizontally and, except for minor dimensional variations, all lie in the same horizontal plane.

Figure 9:
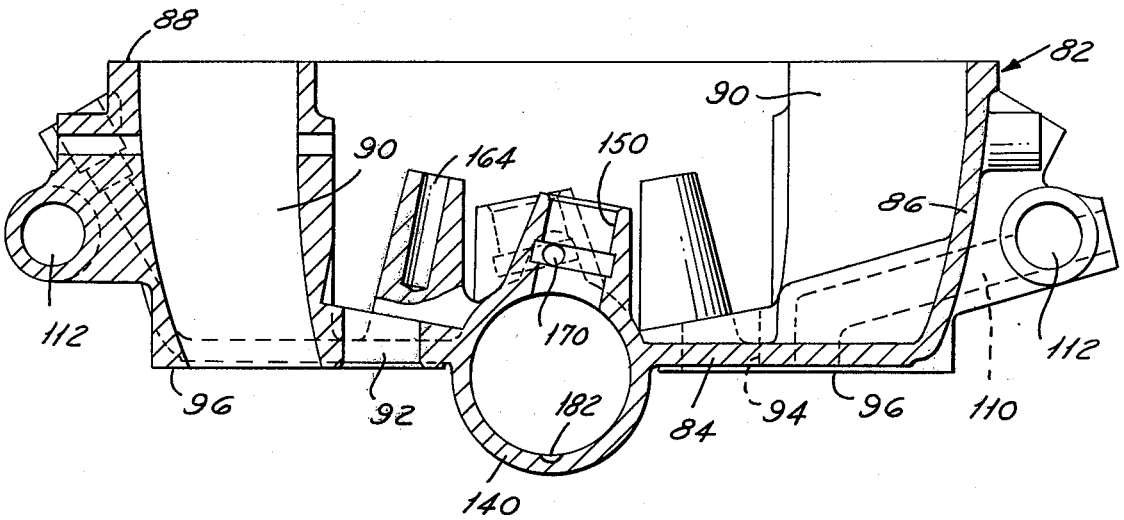
FIG. 9 is a sectional view taken along the line 9—9 in FIG. 5.

The flanges 76,78,80 provide a horizontal seating surface for a valve train casing casting 82, the details of which are best illustrated in FIGS. 5 through 9. Valve train casing casting 82 is formed with a bottom wall 84 and a peripheral side wall 86. The upper end of casting 82 is essentially open and defined by a generally flat peripheral flange 88 (FIG. 9). Within casting 82 there is integrally cast a plurality of tubular passageways 90 each of which extends through the bottom wall 84 thereof and registers with the upper end of the inlet passageway extension 56 on the cylinder head castings 34. Thus, passageways 90 form upward extensions of the intake passageways 58. The bottom wall 84 of casting 82 is also formed with a plurality of openings 92,94 registering, respectively, with the valve stem guides 70 and 74 on the cylinder head castings 34. The portions of bottom wall 84 surrounding these openings are machined flat so that in a four cylinder engine four flat pads 96 are provided, one adjacent the upper end of each cylinder head casting 34.

Figure 3:
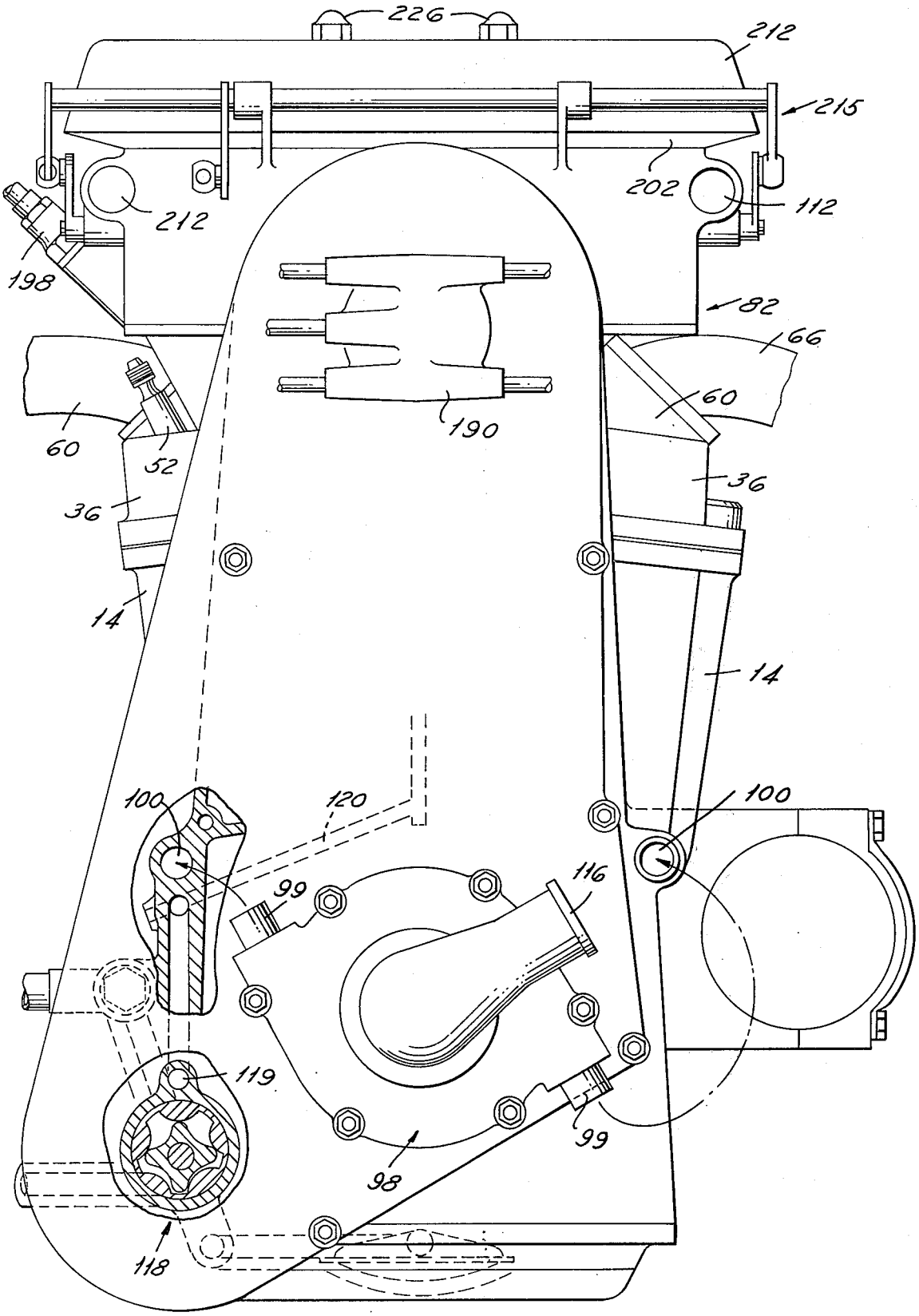
FIG. 3 is a front elevational view of the engine with parts broken away.
Figure 6:
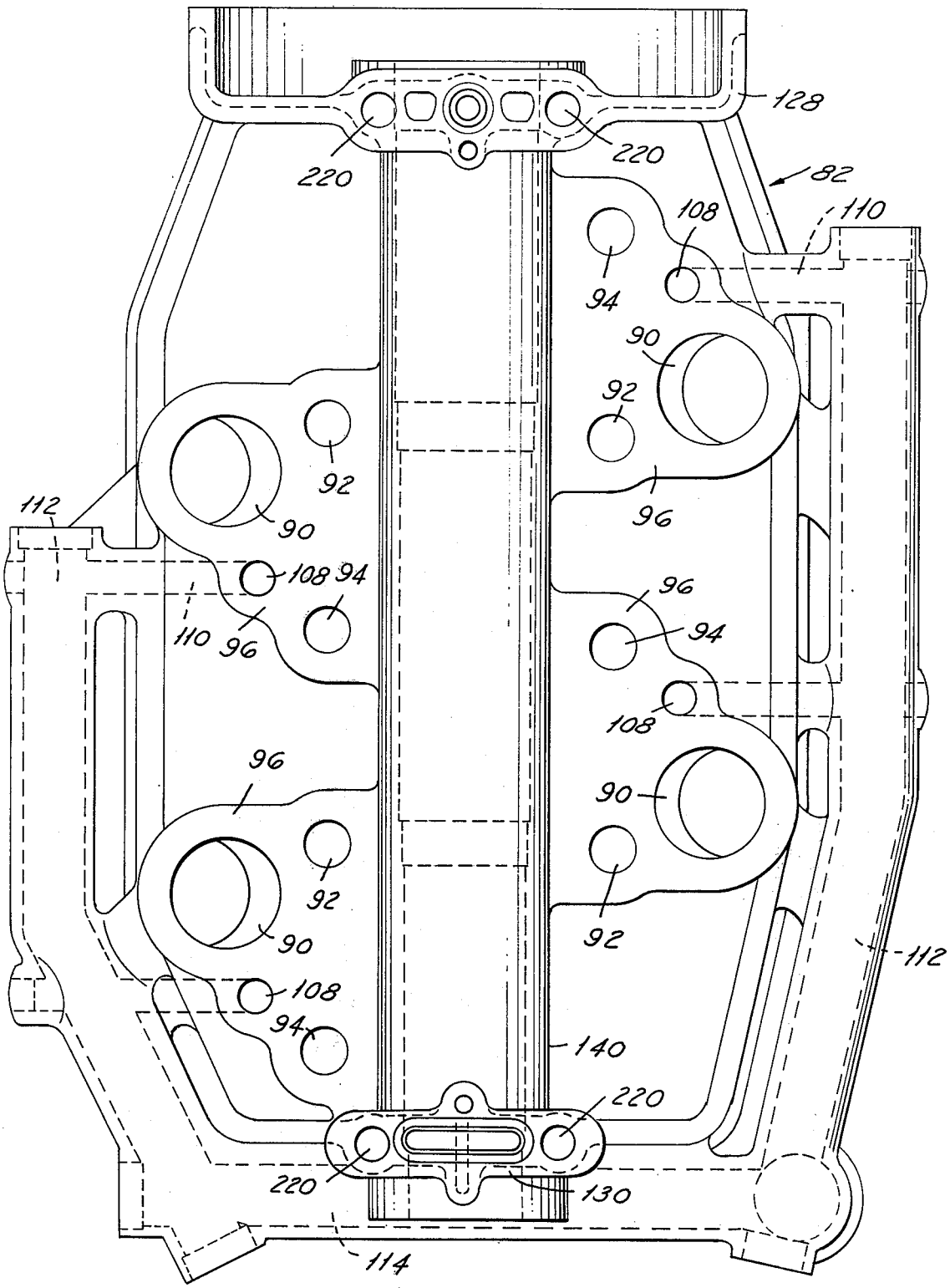
FIG. 6 is a bottom view of the valve train casing casting.

A water pump 98 driven by crankshaft 30 has its outlets 99 connected by suitable cored passageways 100 (FIG. 3) to the annular chambers 102 surrounding the inner wall of each casting 14. The annular chambers 102 are connected with the annular coolant chambers 38 by an aperture 104 in the cylinder head castings 34. The top wall of each cylinder head casting 34 is formed with a passageway 106, the upper end of which registers with an opening 108 in each flat pad 96 on the bottom wall 84 of valve train casing casting 82 (FIG. 6). Openings 108 form the lower ends of coolant passageways 110 in casting 82. These passageways extend laterally outwardly and connect with water mains 112 extending along each side of casting 82. Water mains 112 are interconnected by an integrally cast duct 114 at the rear end of casting 82 which is in turn connected by a suitable hose with the inlet 116 of water pump 98.

There is also arranged at the front end of crankcase 10 an oil pump 118, the outlet 119 of which is connected to a vertically extending oil passageway 120 (FIG. 1). Passageway 120 is formed in a vertically extending bracket 122 cast integrally with crankcase 10 at the front end thereof. A similar passageway 124 formed in an upstanding bracket 125 at the rear end of the crankcase 10 and extends downwardly to a cored horizontal passageway 123 (FIG. 2) which communicates with sump 126 at the lower end of the crankcase. The inlet 127 of oil pump 118 is connected to sump 126 (FIG. 2).

Figure 7:
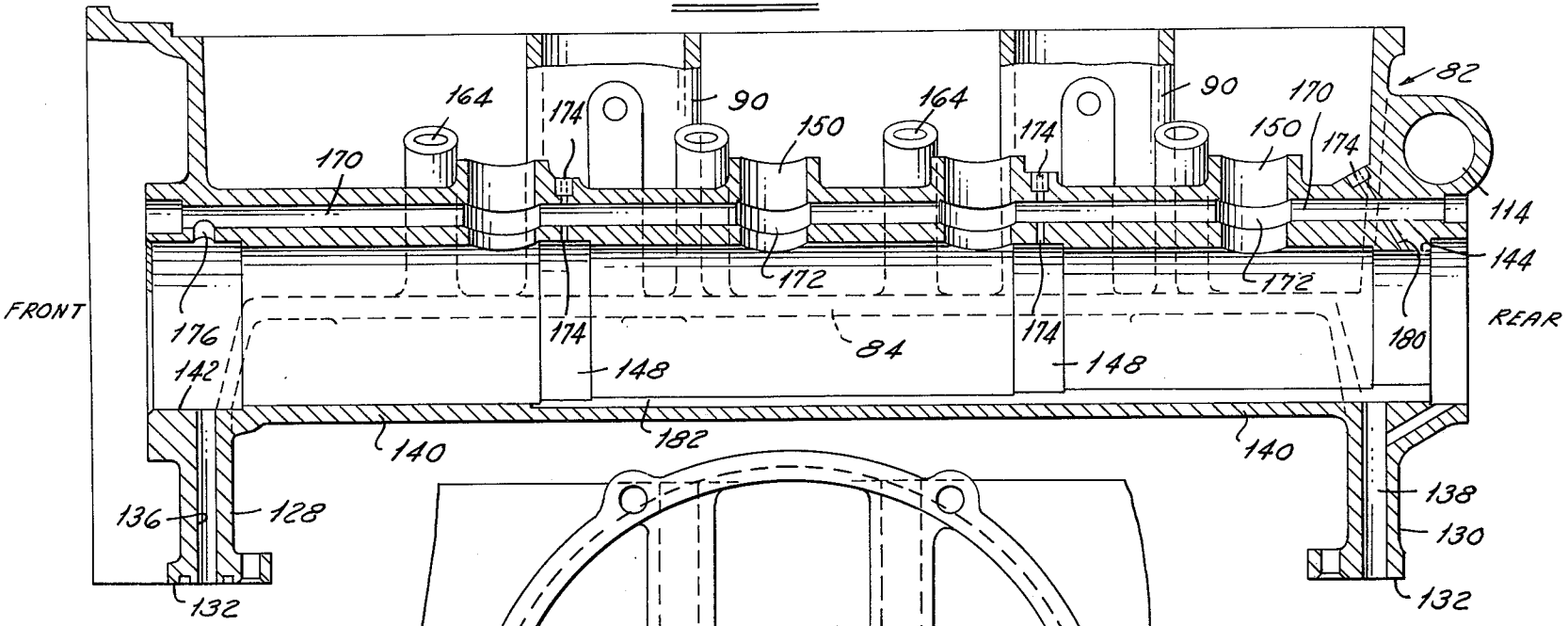
FIG. 7 is a sectional view of the valve train casing casting taken along the line 7—7 in FIG. 5.
Figure 8:
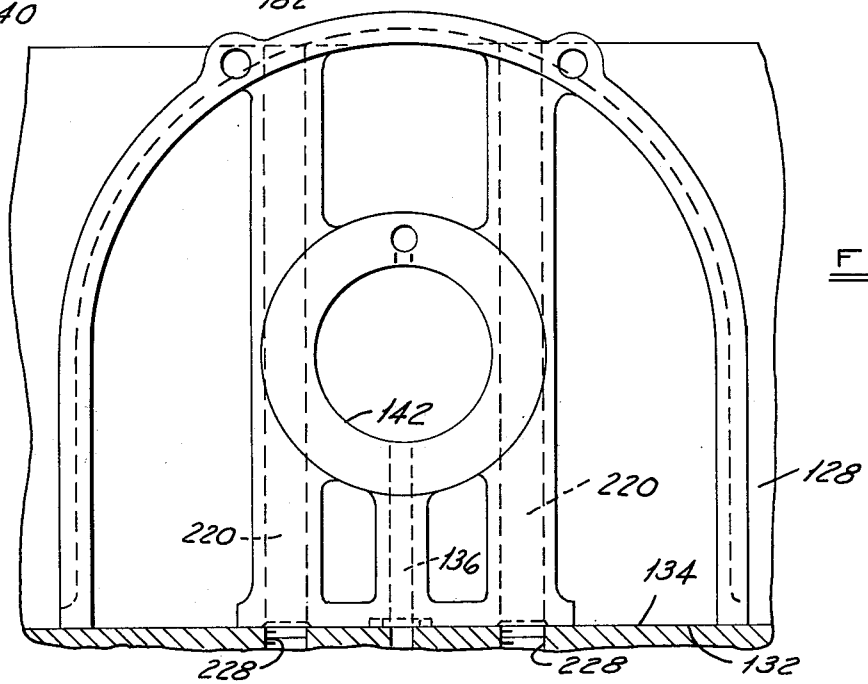
FIG. 8 is a fragmentary end elevational view of the valve train casing casting.

Referring now to FIG. 7, it will be noted that the valve train casing casting 82 is formed with depending brackets 128,130 at the front and rear ends thereof respectively. The lower ends of these brackets are machined with flat faces 132 which are adapted to seat on the machined flat faces 134 at the upper ends of brackets 122,125. These brackets are held in alignment by dowel pins 135 (FIG. 1). Bracket 128 is formed with an oil inlet passageway 136 and bracket 130 is formed with an oil drain passageway 138. Passageways 136,138 register with passageways 120,124, respectively, in the crankcase brackets 122,125.

Figure 5:
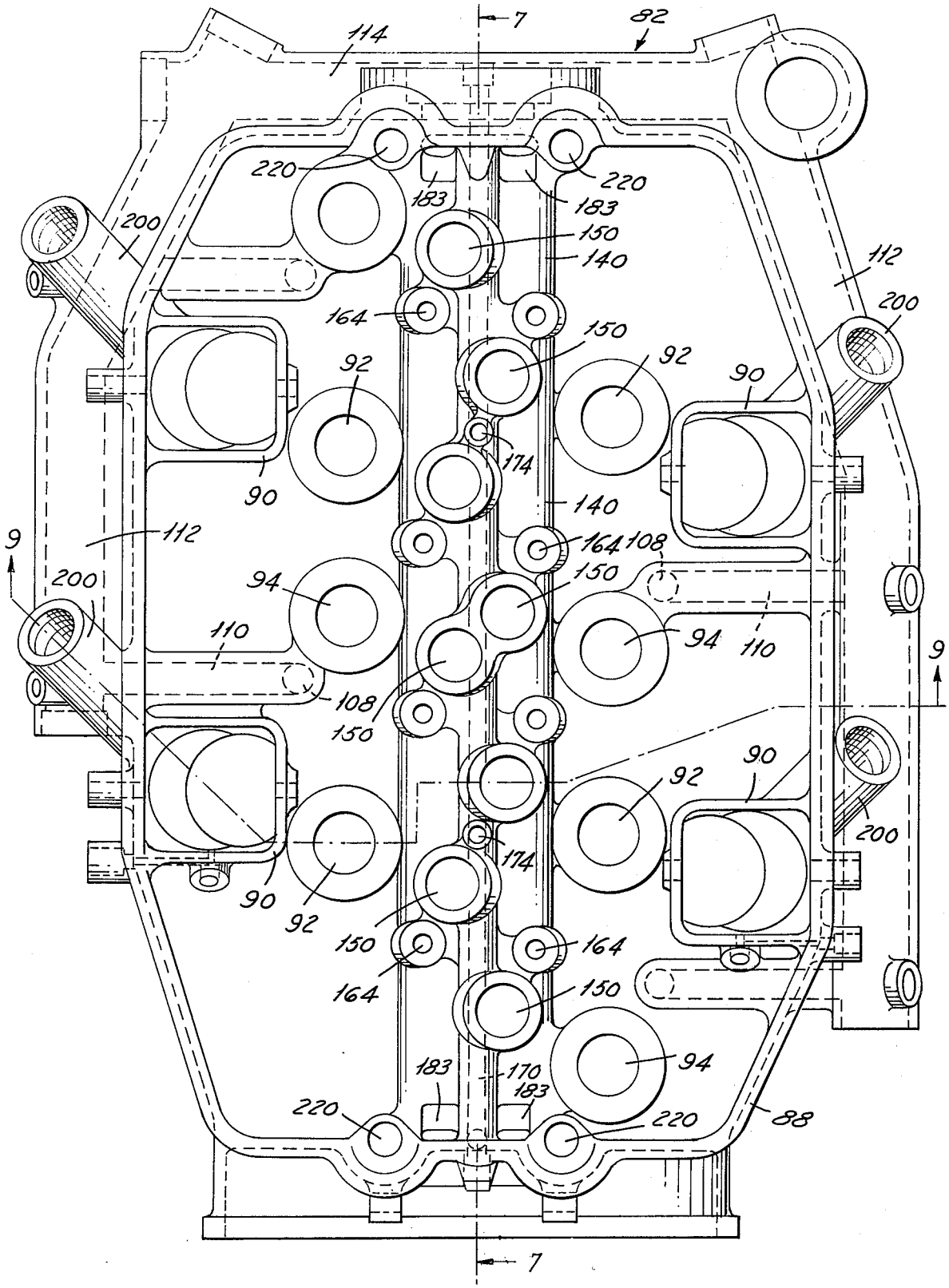
FIG. 5 is a top view of the valve train casing casting.

Valve train casing casting 82 is formedwith a tubular housing 140 extending lengthwise thereof along its formed with center line (FIGS. 2, 5, 6, 7). The lower half of housing 140 lies generally below the plane of bottom wall 84 and the upper half of housing 140 lies above the plane of bottom wall 84. At its opposite ends the tubular housing 140 is formed with bearing sockets 142,144 for supporting the opposite ends of a camshaft 146. Two additional bearing sockets 148 formed intermediate the ends of tubular housing 140 are provided for supporting the camshaft. On the top side of housing 140 there is formed a plurality of oppositely inclined upwardly extending tubular sockets 150 in which hydraulic tappets 152 are retained. The lower ends of tappets 152 are adapted to be engaged by the lobes 154 on camshaft 146. The upper ends of tappets 152 are adapted to engage one end of sheet metal rocker arms 156. Each rocker arm 156 is supported for pivotal movement by a pair of bearings 158 at the opposite ends of a rocker shaft 160 which is in turn supported by a generally vertically extending stud 162. Studs 162 are threaded into openings 164 formed on the upper half of tubular housing 140 (FIGS. 5 and 7). Since in the arrangement illustrated each cylinder is provided with a single intake and a single exhaust valve, there are two tappets 152 for each cylinder. The other end of one set of rocker arms 156 engages the upper end of the intake valve 46 and the other end of the other set of rocker arms engages the upper end of exhaust valve 48. These valves are biased to their closed position in a conventional manner by means of compression springs 166 and retainers 168.

On the top side of tubular housing 140 there is formed an oil duct 170 which extends continuously from one end of the housing to the other. Oil duct 170 communicates with a groove 172 around each tappet socket 150. In addition, oil duct 170 is provided with a plurality of upwardly and downwardly projecting outlets 174 intermediate the ends thereof. At its forward end oil duct 170 is apertured as at 176 so that it will periodically communicate with a drilled passagway 178 extending diametrically through the forward end of camshaft 146. Passageway 178 communicates with the oil inlet passageway 136 in bracket 128 at the forward end of valve train casing casting 82. At its rear end oil duct 170 is apertured as at 180 which extends to the bearing socket 144. A drain passageway 182 is also formed along the bottom side of tubular housing 140. Thus, oil under pressure from pump 118 is directed upwardly through passageway 136 into the oil duct 170 through aperture 176. The oil is then caused to flow rearwardly through oil duct 170 and return through the drain passageway 138 through aperture 180 and the drain passageway 182. In addition, the oil is sprayed upwardly and downwardly within casting 82 to supply the necessary lubrication for the valves, bearings, tappets, etc. The interior of casing 82 communicates with drain passageway 138 through openings 183 in the top half of housing 140 adjacent the front and rear ends thereof (FIG. 5).

At its forward end camshaft 146 is provided with a pulley 184 which is driven by a timing belt 186 from a pulley 188 adjacent the forward end of crankshaft 30. The rotor of a distributor 190 is driven by a key connection 192 with the forward end of camshaft 146. The rear end of camshaft 146 drives a fuel injection device 194 which is connected to each intake passageway 58 by suitable conduits 196. As shown in FIG. 2, a fuel injection nozzle 198 is threaded into an outwardly inclined lug 200 located adjacent inlet passageway extension 90 in valve train casing casting 82. It will be appreciated that carburetors may be employed instead of fuel injection nozzles.

As shown in FIGS. 1 and 2, the upper open end of valve train casing casting 82 is closed by a cover 202 which seats on the flat peripheral flange 88 at the upper end of casting 82. Cover 202 is formed with a plurality of air intake openings 204 which register one with the upper end of each tubular passageway 90. Cover 202 is preferably formed as a sheet metal stamping and at each opening 204 it is formed with a rounded flange 206 to promote a smooth air flow into the intake passageway 58. At the central portion thereof cover 202 is formed with a breather opening 208 so that the interior of valve train casing casting 82 and crankcase 10 communicate with atmosphere.

Above cover 202 there is mounted on the engine a shroud 210 having a depending peripheral flange 212. A peripherally extending air filter 214 is positioned between cover 202 and shroud 210. Air flows through filter 214 under the lower edge of flange 212 and to intake openings 204. The flow of air through each intake passageway is controlled by a pivotally supported throttle valve 213. Throttle valves 213 are conjointly controlled by a throttle linkage 215.

Shroud 210, cover 202 and casting 82 are all mounted in vertically stacked relation on the upper ends of brackets 122,125 by means of threaded studs 216. Between cover 202 and shroud 210 spacer sleeves 218 are telescoped over studs 216. Studs 216 extend downwardly through vertical openings 220 at the opposite ends of casting 82. A soft compressible gasket 222 is arranged between each flat pad 96 on the bottom face of casting 82 and the flanged surfaces 76,78,80 on the cylinder head castings 34. Cover 202 and casting 82 are clamped in position by nuts 224 and shroud 210 is clamped downwardly on the upper ends of spacer sleeves 218 by nuts 226. It will be observed that the use of the soft compressible gaskets 222 enables the casting 82 to be effectively sealed against oil leakage with respect to the openings in the bottom wall thereof even though there may be slight dimensional variations in the height of the respective cylinder head castings 34. The only really critical height dimension on casing 82 is the vertical dimension between the center line of camshaft 146 and the lower flat faces 132 of brackets 128 and 130 at the opposite ends of valve train casing casting 82. Studs 216 at their lower ends thread into threaded openings 228 at the upper ends of the upstanding brackets 122,125 on crankcase 10. The provision of this construction utilizing the soft compressible gasket 222 not only compensates for minor height differences in flanges 76,78,80, but also allows for expansion of the cylinder head castings 34 as a result of the operating temperatures of the engine. It will be appreciated that the only sealing action required of gaskets 222 is for the prevention of oil leakage.

Thus, it will be seen that the invention described herein readily lends itself to the die casting of the valve train casing casting 82 and the individual cylinder head castings 34. The design of these static parts is ideally suited for die casting since it avoids undercuts and, thus, permits straight withdrawal of metallic cores and dies used in die casting. The manufacturing economy is also achieved by casting the intake passageway extensions 90 integral with the valve train casing casting 82 and forming the latter casting with flat pads 96 on the bottom face thereof which seat upon the compressible gasket 222 on the flat flanges 76,78,80 on the cylinder head castings. This construction in combination with the cover 202 and shroud 210 eliminates the need for a separate air intake manifold. At the same time, the breather opening 208 in cover 202 in combination with the openings 183 in casing 82 permits direct recirculation of blow-by gases from the crankcase and improves engine breathing. All of these factors result in an engine having improved efficiency and which can be manufactured at relatively low cost on a mass production basis.

I claim:

1. An internal combustion engine comprising a crankcase casting, a plurality of cylinders on said crankcase casting, a plurality of cylinder head castings, one for each cylinder, mounted on and closing the upper end of each cylinder, said cylinder head castings each having a generally flat flanged surface thereon, the flanged surfaces of all of the cylinder head castings lying in substantially the same horizontal plane, each cylinder head casting having a top wall and an integral generally vertical tubular extension thereon defining an air intake passageway for the cylinder, the upper end of each tubular extension being of annular shape and defining said flat flanged surface, each cylinder head casting also having an integral generally vertically disposed valve stem guide thereon, each valve stem guide being surrounded by said flat flanged surface, a casting defining a valve train casing, said casing having a bottom wall closing the lower end thereof, said bottom wall having a plurality of openings therein spaced apart to correspond and register with the spacing of said valve stem guides and the upper ends of said intake passageway extensions on the cylinder head castings, each of said openings being surrounded by a flat surface on the bottom face of said bottom wall, said valve train casing being seated on said cylinder head castings with a gasket interposed between said flat surfaces thereof, means forming a cover for the upper end of the valve train casing and fastening means securing said valve train casing in a seated position on the upper ends of said cylinder head castings.

2. An engine as called for in claim 1 wherein said gasket is relatively soft and compressible, said fastening means compressing said gasket sufficiently to form a seal against the leakage of oil from the valve train casing around said openings.

3. An engine as called for in claim 2 wherein said fastening means are secured to the crankcase casting.

4. An engine as called for in claim 3 wherein said crankcase casting has a mounting bracket at the opposite ends thereof, said valve train casing being mounted on said brackets and being secured thereto by said fastening means.

5. An engine as called for in claim 4 wherein said brackets project upwardly from said crankcase, said valve train casing also having mounting brackets as opposite ends thereof projecting downwardly below the bottom wall of the casing and seated on the upper ends of said crankcase brackets.

6. An engine as called for in claim 1 wherein said valve train casing has a plurality of integrally cast, vertically extending tubular passageways therein which extend upwardly from each opening in the bottom wall thereof and which register one with the intake passageway of each cylinder and form vertical extensions thereof, said cover means having openings therein registering with the upper end of said tubular passageway in the valve train casing, said cover means including means defining an air intake chamber overlying said openings and communicating with atmosphere for supplying air to each of said air intake passageways.

7. An engine as called for in claim 6 including air filter means in said last-mentioned chamber.

8. An engine as called for in claim 6 including passageway means extending between said crankcase and said valve train casing whereby the blow-by gases in the crankcase are permitted to escape into said valve train casing, said cover means having an opening therein communicating with said air intake chamber for recirculating said gases.

9. An engine as called for in claim 1 wherein said valve train casing is provided with an integrally cast section forming a central bore extending lengthwise thereof, a camshaft journalled in said bore, said valve stem guides being disposed in staggered relation along the laterally opposite sides of said section, said section having a plurality of sockets therein extending downwardly into said bore and tappets seated in said sockets and adapted to be engaged by lobes on the camshaft.

10. An engine as called for in claim 9 including an oil pump having an inlet connected with said crankcase, a passageway extending from the outlet of said oil pump to said valve train casing.

11. An engine as called for in claim 10 wherein said passageway extends to said bore.

12. An engine as called for in claim 10 wherein said passageway extends lengthwise through said section and intersects each of said sockets.

13. An engine as called for in claim 12 wherein said passageway communicates with said bore and with the interior of said valve train casing.

14. An engine as called for in claim 13 including an oil drain passageway extending from within said valve train casing to said crankcase.

* * * * *